US005301591A

United States Patent [19]

Greenberg

[11] Patent Number: 5,301,591

[45] Date of Patent: Apr. 12, 1994

[54] TAPERED SNARE DRUM

[76] Inventor: Mitch Greenberg, 109 N. Milwaukee Ave., Wheeling, Ill. 60090

[21] Appl. No.: 921,632

[22] Filed: Jul. 30, 1992

[51] Int. Cl.[5] ..... G10D 13/02

[52] U.S. Cl. ..... 84/411 R; 84/413

[58] Field of Search ..... 84/411 R, 413, 415, 84/416, 417

[56] References Cited

U.S. PATENT DOCUMENTS

| | | | |
|---|---|---|---|
| 1,113,253 | 10/1914 | Schreiner | 84/411 R |
| 1,381,494 | 6/1921 | Olsen | 84/411 R |
| 3,603,194 | 9/1971 | North | 84/411 R |
| 4,045,264 | 8/1977 | Ludwig et al. | 84/411 R |
| 4,168,646 | 9/1979 | May | 84/411 R |

*Primary Examiner*—Richard A. Wintercorn
*Assistant Examiner*—Cassandra Spyrou
*Attorney, Agent, or Firm*—W. Dennis Drehkoff

[57] ABSTRACT

A snare drum having an improved resonant, sensitive and harmonic sound. The snare drum comprises a head end, a snare end is substantially circular at its head end while being increasingly larger in transverse cross-sectional shape proceeding from the head end towards the snare end. An indentation adjacent the head end allows a drum skin to be positioned within a hoop and tightened to secure the skin and hoop without binding.

5 Claims, 2 Drawing Sheets

TAPERED SNARE DRUM

BACKGROUND

This invention relates to a snare drum, and more particularly to an improved snare drum that has a small head, a larger base and that produces a resonant, sensitive and harmonic sound.

A musical drum consists of a cylindrical drum shell over the open ends of which drum heads are tensioned. Each drum head consists of a circular "skin" having a diameter slightly greater than the diameter of the drum shell and a hoop being secured to the periphery of the skin. The skin rests against an angular bearing edge of the drum shell with a hoop lying along side the outer surface of the drum shell.

Pressure is applied to the hoop in a direction away from the bearing edge in order to create tension on the skin. Pressure may be applied to the drum shell in a variety of ways, many of which involve the use of fittings or brackets secured to the drum shell and upon which a tensioning device for the skin may be secured. With this type of drum, as the pressure on the skin is increased, mechanical distortion of both the top and bottom hoops may occur. Further, with certain levels of pressure on the drum head, there may be a tendency for the drum brackets to be dislodged from the drum shell, thus altering the skin pressure. Still further, the adjustment of the skin by the brackets may also bind the skin so there will be uneven pressure on the skin thus altering the skin pressure and sound.

Tapered musical drums have been in existence for some time. U.S. Pat. No. 1,113,253 discloses a tapered, collapsible drum with a head smaller in diameter than its base. The body portion of the drum is flexible so that vertical supporting bars can be removed to allow the drum body to completely collapse or telescope, thus materially reducing the size of the drum and facilitating the conveyance or shipment of the drum. The taper of the drum, running from the smaller head to the larger base was designed purely for the function of collapsing the drum for transport.

There is a need for a tapered drum that is resonant, sensitive and harmonic while yet allowing the tensioning of the head to be accomplished in such a matter so that there are no dislodgings of the drum brackets, binding of the skin or other aberrations that would alter the skin pressure and quality of sound being emitted from the drum.

SUMMARY OF THE INVENTION

In accordance with the present invention there is provided a musical drum having a head end, a snare end and being substantially circular at its head end and being increasing larger in transverse cross-sectional shape proceeding from the head end towards the snare end. The drum shell further includes an indentation which is substantially adjacent the head end and along the circumference of the outside wall of the shell which allows the drum skin to be positioned within a hoop and tightened by brackets to secure the skin without binding of the skin to produce resonant and sensitive sounds.

It is an object of the invention to provide a drum shell having a head end and a snare end with the drum shell having a taper running from the smaller head end to the larger snare end.

A further object of this invention is to provide a drum shell being substantial circular at its head end and being increasingly larger in transverse cross-sectional shape proceeding from the head end toward the snare end.

A further object of the invention is to provide a drum shell which allows the tensioning or tightening of the drum head by fittings or brackets engaged to hoops around the drum skin in such a manner that the drum skin does not bind.

Another object of the invention is to provide a drum shell with a substantially circular indentation on the circumference of the outside wall of the drum shell substantially adjacent to the head end of the drum shell to allow the tensioning of the drum head without binding.

Another object of the invention is to provide a drum shell capable of producing a wide range of harmonic and overtone frequencies.

DESCRIPTION OF THE INVENTION

Figure 1:
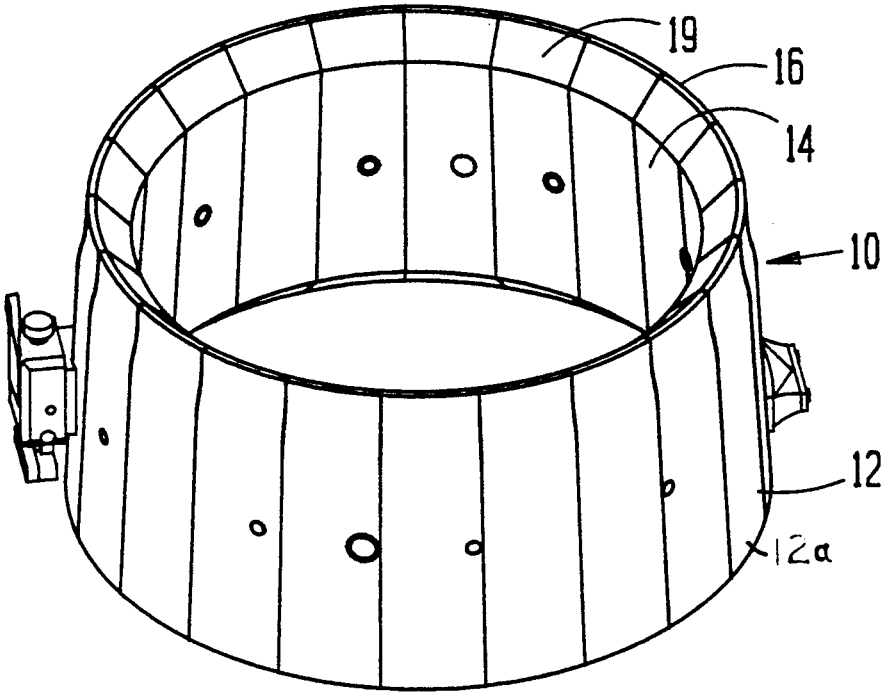
FIG. 1 is a perspective view of a drum shell of the present invention.
Figure 2:
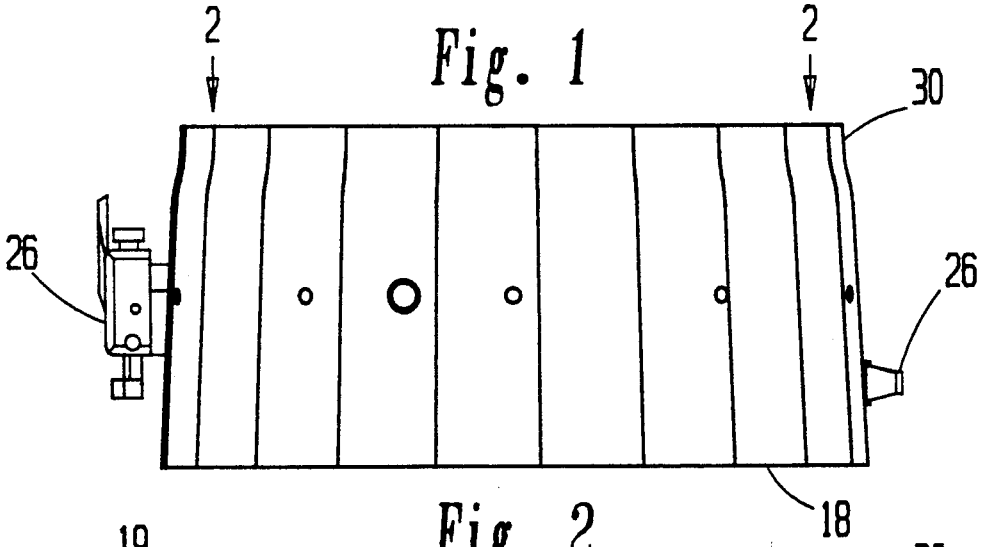
FIG. 2 is a side elevational view of the drum shell of the present invention.

A tapered drum shell 10, as shown in FIGS. 1 and 2, forming a specific embodiment of the invention is formed of materials selectively utilized for their resonant quality. These materials may be wood selected from the group consisting of maple, walnut, birch and alder. Other materials may include rigid plastic, for example, polyvinylchloride, fiber glass, resins, and metals. The embodiment depicted in the drawings shows the conical shell 10 and separate staves 12*a*, precisely machined and glued in a vertical manner. This embodiment is preferred, however, it is not intended to be limitative. The shell 10 has an outside wall 12, an inside wall 14 with a head end 16 and a snare end 18. Shoulder 19 allows the inside wall 14 to meet the outside wall 12. The head end receives a skin 20 for beating and the snare end engages its snare or wires 22 onto skin 24 to provide for the distinctive sound of a snare drum.

Figure 3:
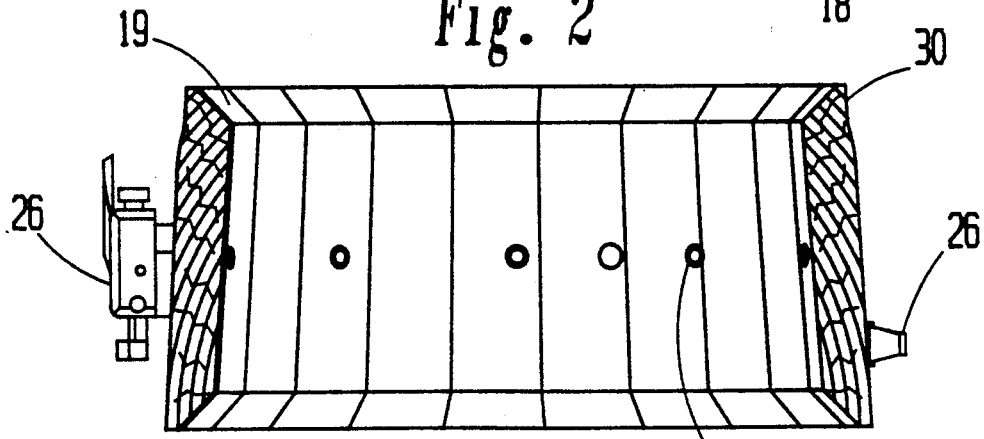
FIG. 3 is a sectional view taken along line 2—2 of FIG. 2.

The taper of the shell is evident upon viewing the drum shell which is substantially circular at its head end and being increasingly larger in transverse cross-sectional shape proceeding from the head end 16 toward the snare end 18. The head end 16 is of a smaller diameter than the snare end 18. The particular taper of the shell is best seen in FIG. 3. The taper of the shell allows for a resonant and sensitive drum that has a brighter harmonic than that available with conventional drum shells.

Also shown in FIG. 2 are means 26 for engaging and disengaging snare wires 22. Aperatures 28 are shown in the shell which are used for fittings for holding the skin 20 and 24.

A substantially circular indentation or graduated staged indentation 30 is positioned on the circumference of the shell on the outer wall 12, substantially adjacent head end 16. This indentation 30 allows for the fastening of skin 20 without binding or in any way altering skin pressure to a detrimental effect. The shell wall is made substantially thick to assist in the procurement of the skin on the wall with extreme head tension without binding the skin or hoop 32 to the shell. Typically, without being limitative, the shell walls may have a thickness of about one inch.

Figure 4:
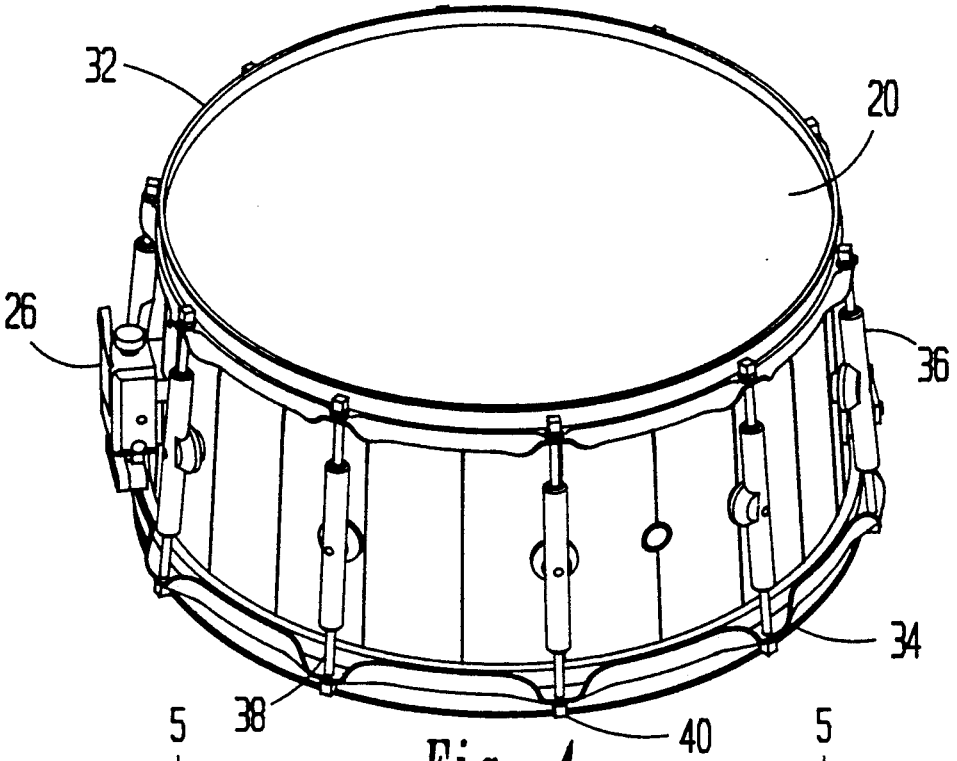
FIG. 4 is a perspective view of a drum of the present invention.
Figure 5:
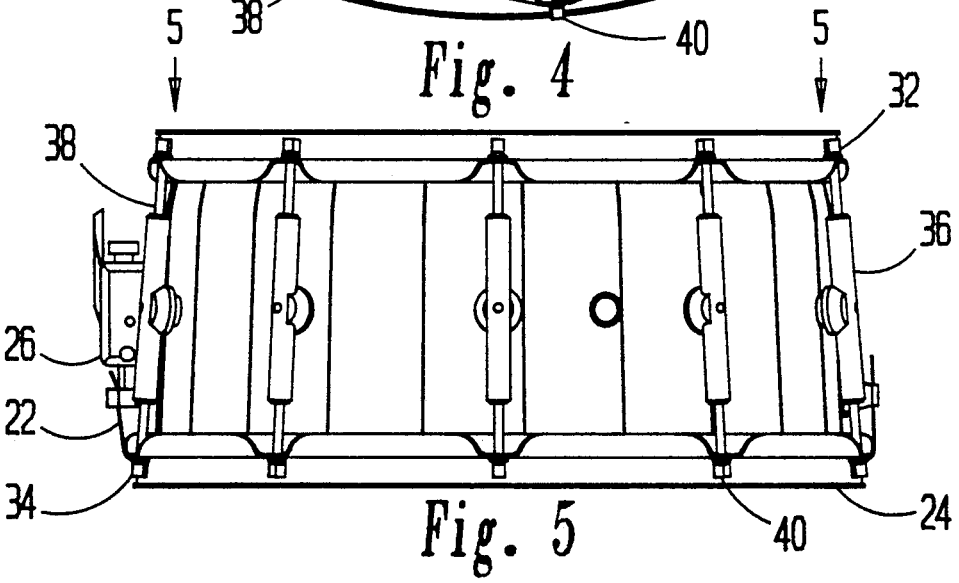
FIG. 5 is a side elevational view of a drum of the present invention.

Referring to FIG. 4, top hoop 32 and lower hoop 34 are shown on the drum shell engaging skin 20 and 24. The hoops are adjusted by brackets 36 and tensioning studs 38 which have caps 40 for adjustment. As the tensioning studs are adjusted, the hoops are tightened around skin 20 and 24 to provide adequate and sufficient pressure for beating the skin and for the snare wires 22 to function. Indentation 30 allows contact of the skin on the outer wall 12 of the shell while engaging top hoop 32 in such a manner that the skin does not bind against the outside wall 12 of the shell. Referring specifically to FIG. 5, it will be seen that the brackets 36 are mounted on the outside wall 12 of the shell and tensioning studs 38 passing through the top hoop 32 and lower hoop 34 for securing the hoops to the skins with caps 40.

Figure 6:
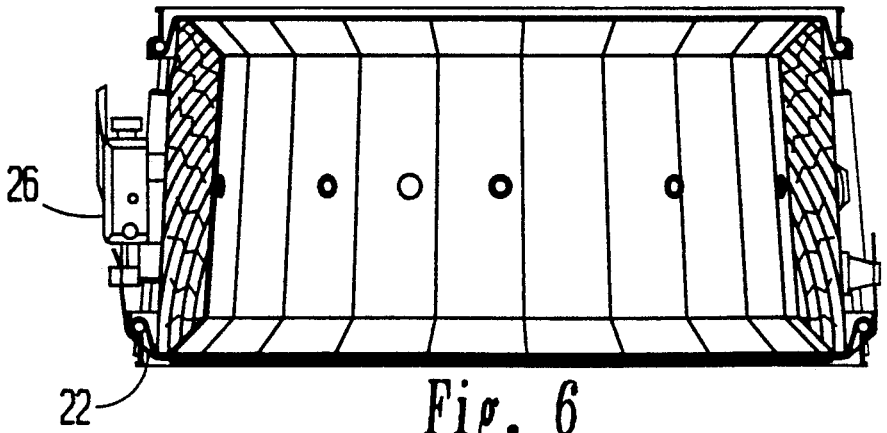
FIG. 6 is a sectional view of line 5—5 of FIG. 5.

In order to have a better view of the taper of the shell and the fitting of top hoop 32 and lower hoop 34 on skins 20 and 24, a cross-sectional view is shown in FIG. 6.

The construction of the rigid shell with indentation 30 running the circumference of the outside wall of the shell provides for attachment of the skin 20 to the shell without binding of the skin or hoop. Further, the tapered shape of the shell provides for a sensitive resonant sound from the drum and a wide range of harmonic and overtone frequencies. Being tapered, the shell is not uniform in shape, therefore causing a wide range of tonal variations.

While I have shown and described certain embodiments of my invention, it is to be understood that it is capable of many modifications. Changes, therefore, in the construction and arrangement may be made without departing from the spirit and scope of the invention as disclosed in the independent claims.

What is claimed is:

1. A rigid drum shell comprising:

outside and inside walls;

a head end for engaging a first drum skin and having a first diameter;

a snare end for engaging a second drum skin and snare wires, having a second diameter;

the drum shell being substantially circular at the head end and being increasingly larger in transverse cross sectional shape proceeding from the head end toward the snare end; and a substantially circular indentation on the circumference of the outside wall substantially adjacent the head end for engaging the first drum skin with a hoop in a manner so that the first drum skin does not bind against the outside wall of the drum shell.

2. The drum shell according to claim 1 wherein the first diameter is smaller than the second diameter of the snare end.

3. The drum shell according to claim 1 wherein the inside wall forms a shoulder for supporting the drum skin at the head end.

4. A muscial drum having a wide range of harmonic and overtone frequencies comprising:

a drum shell having a head end with a first diameter and a snare end with a second diameter and having an outside wall and an inside wall;

a first drum skin positioned on the head end and a second drum skin positioned on the snare end;

a top hoop securing the first skin to the shell and a lower hoop securing the second skin to the shell;

means for adjusting the top and lower hoops to adjust the tension of the first and second drum skins;

the first diameter of the head end of the shell being smaller then the second diameter of the snare end of the shell; and an indentation running the circumference of the shell substantially near the head end and on the outside wall of the shell for engaging the first drum skin with the top hoop in a manner so that the first drum skin does not bind against the outside wall of the drum shell.

5. The musical drum according to claim 4 wherein the drum shell is constructed of wood staves positioned in a vertical manner.

* * * * *